US007008283B2

(12) United States Patent
Liu et al.

(10) Patent No.: US 7,008,283 B2
(45) Date of Patent: Mar. 7, 2006

(54) METHOD FOR MANUFACTURING HIGH-BRIGHTNESS PLANAR LAMP

(75) Inventors: Chih Yung Liu, Hsinchu Hsien (TW); De-An Chang, Hsin Chu (TW); Sheng Chih Wan, Hsinchu Hsien (TW)

(73) Assignee: Candle Laboratory Co., Ltd., Taipei (TW)

( * ) Notice: Subject to any disclaimer, the term of this patent is extended or adjusted under 35 U.S.C. 154(b) by 121 days.

(21) Appl. No.: 10/372,129

(22) Filed: Feb. 25, 2003

(65) Prior Publication Data

US 2004/0166759 A1 Aug. 26, 2004

(51) Int. Cl.
*H01J 9/00* (2006.01)
*H01J 9/24* (2006.01)

(52) U.S. Cl. ..... 445/24; 445/14; 445/11; 427/64; 427/67

(58) Field of Classification Search ..... 445/14, 445/24, 26, 58; 427/66, 67, 7
See application file for complete search history.

(56) References Cited

U.S. PATENT DOCUMENTS 2,924,732 A * 2/1960 Lehmann ..... 313/506
6,086,441 A * 7/2000 Akiguchi et al. ..... 445/24
6,340,824 B1 * 1/2002 Komoto et al. ..... 257/99

FOREIGN PATENT DOCUMENTS

JP 08-287714 * 11/1996

* cited by examiner

*Primary Examiner*—Mariceli Santiago
*Assistant Examiner*—Elizabeth Rielley
(74) *Attorney, Agent, or Firm*—Baker & McKenzie

(57) ABSTRACT

In a method for manufacturing a high-brightness planar lamp, a reflecting plate is first provided, and several UV light sources are placed on the reflecting plate. Next, liquid macromolecular polymer is uniformly coated on the reflecting plate and the UV light sources, and fluorescent powder is then uniformly coated on the macromolecular polymer. In another method for manufacturing a high brightness planar lamp, a reflecting plate is first provided, and several UV light sources are placed on the reflecting plate. Next, fluorescent powder and liquid macromolecular polymer are mixed up and uniformly coated on the reflecting plate and the UV light sources. A solidification procedure is then performed. The solidification ways of the mixture of fluorescent powder and macromolecular polymer includes solidification by heating and solidification by illumination of UV light.

13 Claims, 3 Drawing Sheets

METHOD FOR MANUFACTURING HIGH-BRIGHTNESS PLANAR LAMP

FIELD OF THE INVENTION

The present invention relates to a planar lamp and, more particularly, to a planar lamp having uniform color temperature and high brightness and without the needs of vacuuming, gas filling and high temperature sealing.

BACKGROUND OF THE INVENTION

As shown in FIG. 1, in a conventional cold cathode fluorescent planar lamp 10, gas sealed in a cavity is first exhausted out via an exhaust pipe 15, and noble gas or mercury vapor 11 is then filled. Next, a high voltage is applied across electrodes 12 and 12' to cause electron migration between the electrodes 12 and 12'. During the process of electron migration, electrons 16 will impact gas molecules to excite the mercury vapor 11 sealed in the cavity to radiate out ultraviolet (UV) light 13. The UV light 13 will thus excite a fluorescent powder layer 17 coated on the inner wall of the cold cathode fluorescent planar lamp 10 to emit visual light 14. In addition to the complicated procedure of vacuuming, steps of coating fluorescent powder on the inner wall of the cold cathode fluorescent planar lamp 10 needs to be performed within a high temperature range from 400° C. to 800° C. to evaporate organic solvent in the fluorescent powder layer 17, hence adhering fluorescent powder to the inner wall of the cold cathode fluorescent planar lamp 10. If the organic solvent in the fluorescent powder layer 17 is not fully evaporated, a color of burned black will occur at the electrodes of the cold cathode fluorescent planar lamp 10 after a longtime illumination. Besides, if fluorescent powders of the red, green and blue colors are not uniformly coated, shift of color temperature of the visual light may occur. Therefore, how to manufacture a visual light source with uniform color temperature and high brightness but without complicated procedures is an urgent problem to be solved in the industry.

SUMMARY AND OBJECTS OF THE PRESENT INVENTION

The primary object of the present invention is to provide a visual light planar lamp having uniform color temperature and high brightness and without the needs of vacuuming, noble gas filling and high temperature sealing so as to solve the problems in the prior art.

The secondary object of the present invention is to provide a mixture of fluorescent powder and liquid macromolecular polymer coated on the outside of a UV light tube to obtain a good planar light source by means of a solidification procedure.

Another object of the present invention is to provide a transparent macromolecular polymer having the functions of diffusing and guiding light.

Still another object of the present invention is to provide a reflecting plate for reflecting UV light to enhance the utility rate of UV light for increase the luminescent probability of fluorescent powder.

In a method for manufacturing a high-brightness planar lamp of the present invention, a reflecting plate is first provided, and several UV light tubes are placed on the reflecting plate. Next, liquid macromolecular polymer is uniformly coated on the reflecting plate and the UV light tubes, and fluorescent powder is then uniformly coated on the macromolecular polymer. In another method for manufacturing a high-brightness planar lamp of the present invention, a reflecting plate is first provided, and several UV light tubes are placed on the reflecting plate. Next, fluorescent powder and liquid macromolecular polymer are mixed up and uniformly coated on the reflecting plate and the UV light tubes. A solidification procedure is then performed. The solidification ways of the mixture of fluorescent powder and macromolecular polymer includes solidification by heating and solidification by illumination of UV light.

The various objects and advantages of the present invention will be more readily understood from the following detailed description when read in conjunction with the appended drawings, in which:

DETAILED DESCRIPTION OF PREFERRED EMBODIMENT

Figure 1:
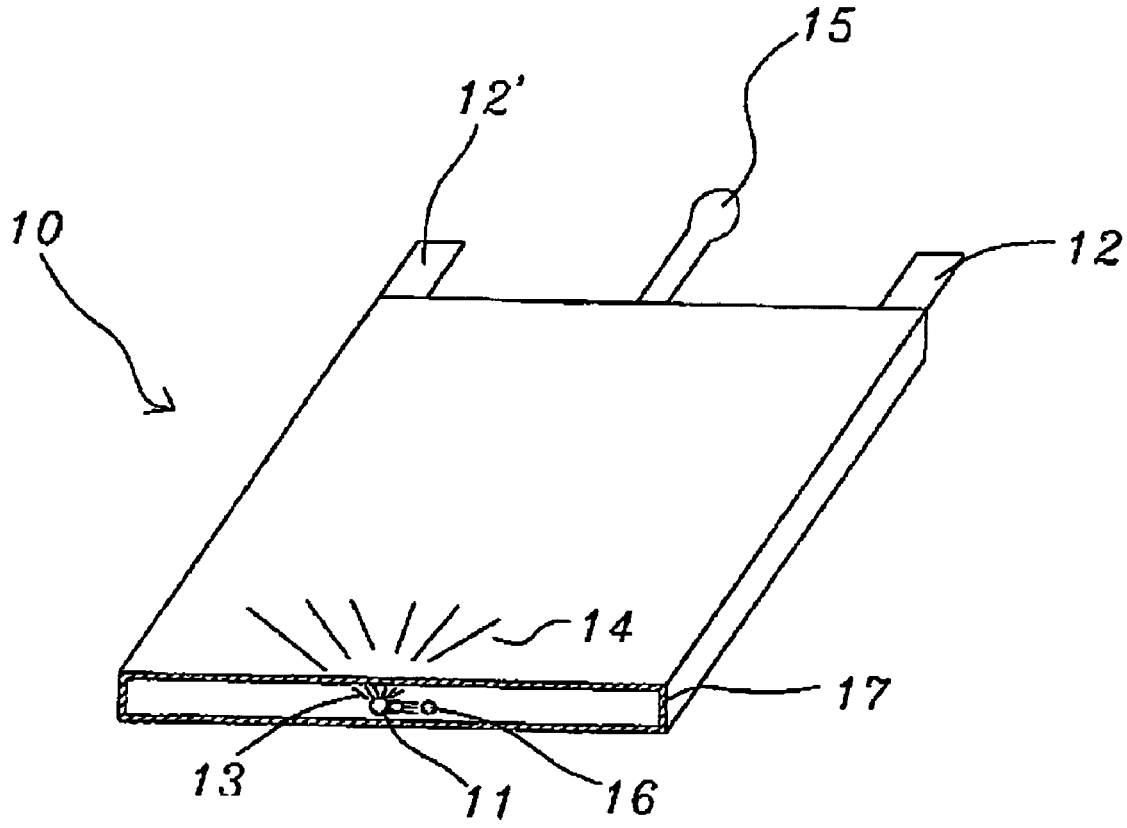
Fig. 1 (Prior Art)
FIG. 1 is a perspective view of a cold cathode fluorescent planar lamp in the prior art.
Figure 2A:
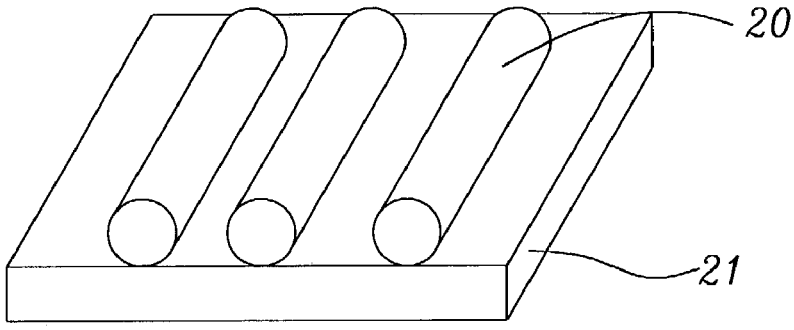
FIG. 2 is a first flowchart of manufacturing a planar lamp with uniform color temperature and high brightness of the present invention.
Figure 2B:
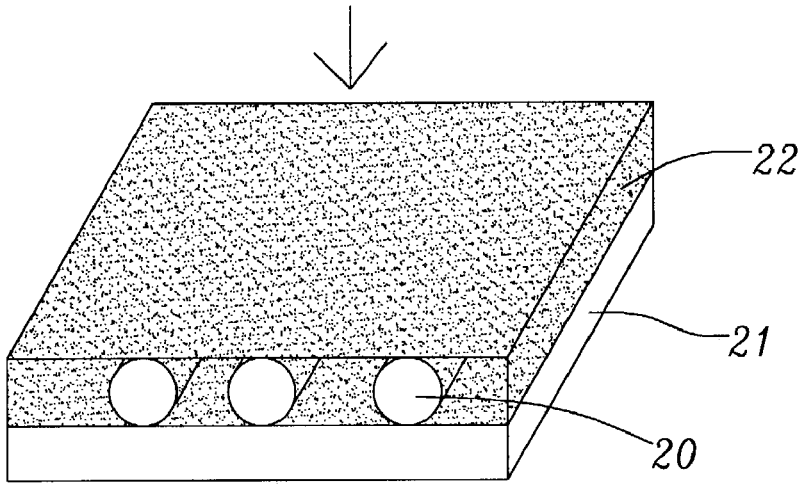
Figure 2C:
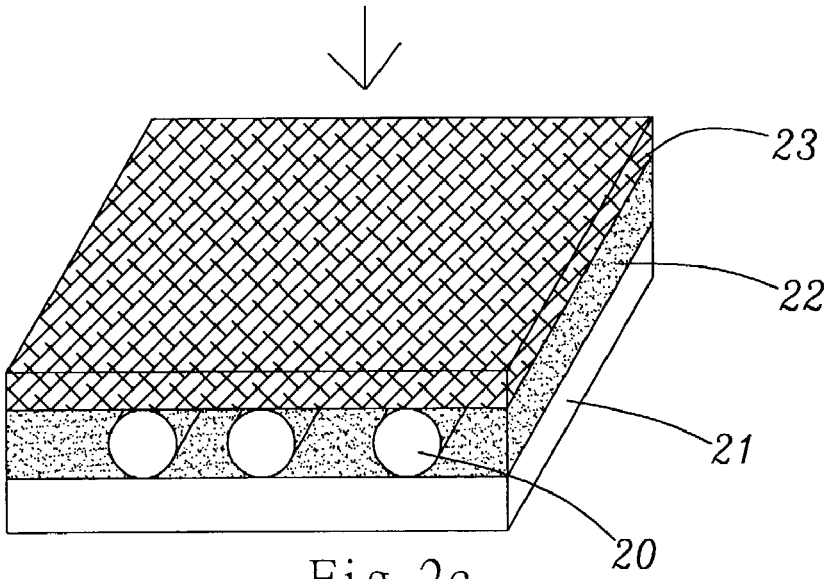

FIG. 2 is a first flowchart of manufacturing a planar lamp with uniform color temperature and high brightness of the present invention. First, a reflecting plate 21 is provided, and several UV light sources 20 are placed on the reflecting plate 21, as shown in FIG. 2*a*. The reflecting plate 21 is used to reflect UV light emitted by the UV light sources 20. The UV light sources 20 refer in general to any light source capable of emitting UV light, and are preferred to be UV light tubes and UV light-emitting diodes. Next, liquid macromolecular polymer 22 is uniformly coated on the reflecting plate 21 and the UV light sources 20, as shown in FIG. 2*b*. The coating way can be printing, casting, spin coating, spray, roller coating or table coating, and is preferred to be spray. Fluorescent powder 23 is then uniformly coated on the macromolecular polymer 22 by viscosity of the liquid macromolecular polymer 22, as shown in FIG. 2*c*. The coating way can be printing, casting, spin coating, spray or electrostatic coating, and is preferred to be electrostatic coating. Because the reflecting plate 21 has the capability of reflecting UV light and the macromolecular polymer 22 has the functions of diffusing and guiding light, UV light generated by the UV light sources 20 can be uniformly incident into the fluorescent powder 23 to generate visual light with uniform color temperature and high brightness.

Figure 3A:
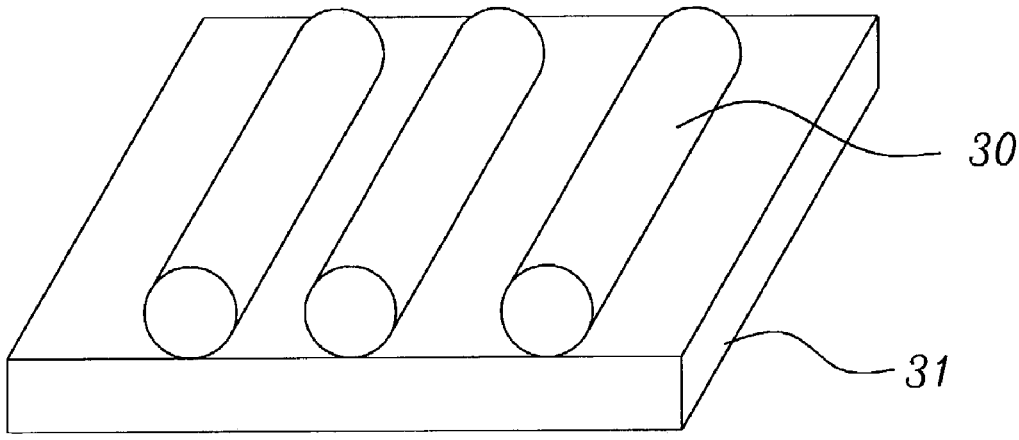
FIG. 3 is a second flowchart of manufacturing a planar lamp with uniform color temperature and high brightness of the present invention.
Figure 3B:
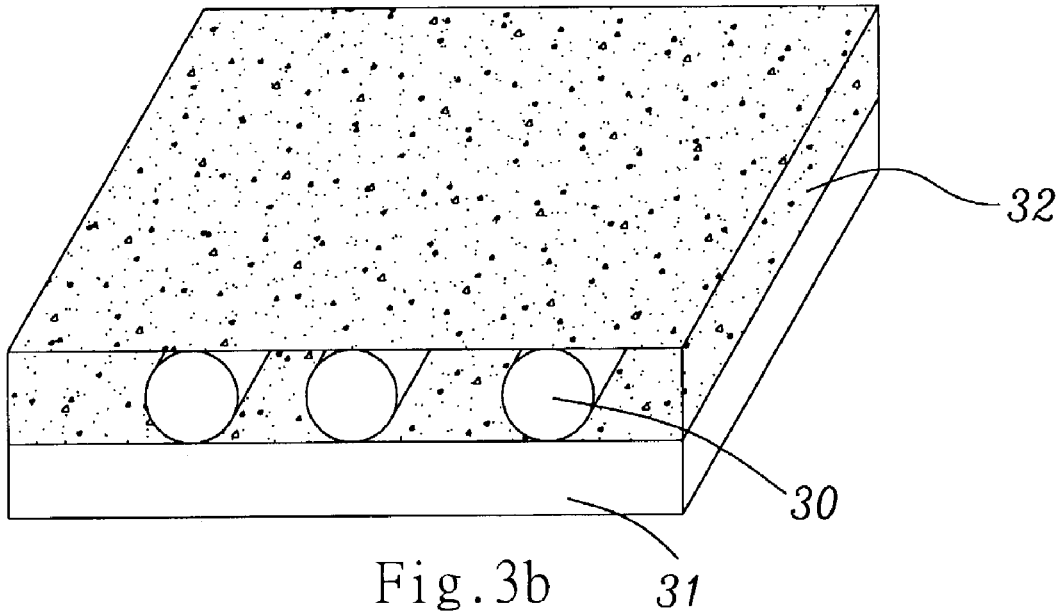

FIG. 3 is a second flowchart of manufacturing a planar lamp with uniform color temperature and high brightness of the present invention. First, a reflecting plate 31 is provided, and several UV light sources 30 are placed on the reflecting plate 21, as shown in FIG. 3*a*. The reflecting plate 31 is used to reflect UV light emitted by the UV light sources 30. The UV light sources 30 refer in general to any light source capable of emitting UV light, and are preferred to be UV light tubes and UV light-emitting diodes. Fluorescent powder and liquid macromolecular polymer are then mixed up and uniformly coated on the reflecting plate 31 and the UV light sources 30 to become a mixture 32 of fluorescent powder and macromolecular polymer. The coating way can be printing, casting, spin coating, spray, roller coating or table coating, and is preferred to be spray. Next, the reflecting plate 31 and the UV light sources 30 having the mixture 32 of fluorescent powder and liquid macromolecular polymer coated thereon are solidified by heating at a temperature between 20 and 80 degrees of centigrade or are solidified by illumination of UV light. Because the mixture 32 of fluorescent powder and liquid macromolecular polymer has the function of converting UV light into visual light and the functions of diffusing and guiding light, UV light generated by the UV light sources 30 can be uniformly dispersed to generate visual light with uniform color temperature and high brightness.

To sum up, the present invention can avoid the procedures of vacuuming, noble gas or mercury vapor filling and planar lamp sealing in the conventional method for manufacturing a cold cathode fluorescent planar lamp. Especially, comparing to the manufacturing procedure of the conventional cold cathode fluorescent planar lamp, the steps of coating fluorescent powder on the outside wall of the cold cathode fluorescent planar lamp of the present invention are simpler than coating on the inner wall of the cold cathode fluorescent planar lamp. Moreover, because fluorescent powder is mixed with liquid macromolecular polymer to achieve a better uniformity, a light source with more uniform color temperature and higher brightness can be obtained as compared to the conventional cold cathode fluorescent planar lamp.

Although the present invention has been described with reference to the preferred embodiments thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

What is claimed is:

1. A method of manufacturing a planar lamp with uniform color temperature and high brightness, comprising the steps of: (a) providing a reflecting plate and at least one UV light source; (b) coating liquid macromolecular polymer on said reflecting plate and said UV light source uniformly; and (c) coating fluorescent powder on said liquid macromolecular polymer uniformly, wherein at least one of the at least one UV light source in said step (a) is a UV light tube.

2. The method as claimed in claim 1, wherein said reflecting plate is a plate capable of reflecting UV light.

3. The method as claimed in claim 1, wherein said macromolecular polymer has the function of light diffusing.

4. The method as claimed in claim 1, wherein said macromolecular polymer has the function of light guiding.

5. The method as claimed in claim 1, wherein said coating way in said Step (b) is chosen from printing, casting, spin coating, spray, roller coating and table coating.

6. The method as claimed in claim 1, wherein said coating way in said Step (c) is chosen from printing, casting, spin coating, spray and electrostatic coating.

7. A method of manufacturing a planar lamp with uniform color temperature and high brightness, comprising the steps of: (a) providing a reflecting plate and at least one UV light source; (b) mixing fluorescent powder and liquid macromolecular polymer; (c) coating said mixture of fluorescent powder and liquid macromolecular polymer uniformly on said reflecting plate and said at least one UV light source; and (d) solidifying said reflecting plate and said at least one UV light source having said mixture of fluorescent powder and liquid macromolecular polymer coated thereon, wherein at least one of said at least one UV light source in said step (a) is a UV light tube.

8. The method as claimed in claim 7, wherein said reflecting plate is a plate capable of reflecting UV light.

9. The method as claimed in claim 7, wherein said macromolecular polymer has the functions of light-diffusing.

10. The method as claimed in claim 7, wherein said macromolecular polymer has the function of light guiding.

11. The method as claimed in claim 7, wherein said coating way in said Step (c) is chosen from printing, casting, spin coating, spray, roller coating and table coating.

12. The method as claimed in claim 7, wherein said way of solidification in said Step (d) is solidification by heating within a temperature range from 20 to 80 degrees of centigrade.

13. The method as claimed in claim 7, wherein said way of solidification in said Step (d) is solidification by illumination of UV light.

* * * * *